US005406637A

United States Patent [19]

Gonzalez

[11] Patent Number: 5,406,637

[45] Date of Patent: Apr. 11, 1995

[54] SPEAKER ENCLOSURE ASSEMBLY

[76] Inventor: Hector M. Gonzalez, 2898 Briarcliff Rd., Atlanta, Ga. 30329

[21] Appl. No.: 113,071

[22] Filed: Oct. 4, 1993

[51] Int. Cl.[6] ..... H04R 25/00

[52] U.S. Cl. ..... 381/154; 381/159; 181/156

[58] Field of Search ..... 181/156, 199, 160, 155, 181/196, 197, 198; 381/154, 159, 158, 153, 88, 90, 87, 188; 219/756, 745

[56] References Cited

U.S. PATENT DOCUMENTS 5,109,422 4/1992 Furukawa ..... 381/90

FOREIGN PATENT DOCUMENTS 2509369 10/1976 Germany ..... 181/156
0117795 7/1983 Japan ..... 181/199
0135294 6/1986 Japan ..... 381/159
0159898 6/1992 Japan .
0183976 7/1993 Japan ..... 381/159

*Primary Examiner*—Forester W. Isen
*Assistant Examiner*—Huyen D. Le
*Attorney, Agent, or Firm*—Hopkins & Thomas

[57] ABSTRACT

A speaker enclosure assembly (10) having an enclosure cabinet (11) in which a speaker (26) is mounted. The speaker (26) creates an airflow within the enclosure cabinet (11) as the speaker (26) is vibrated for the transmission of sound. The airflow tends to resonate as it is bounced off of the upper, lower, front, rear, and side and end panels (14, 16, 17, and 18) of the enclosure cabinet (11), and is directed into a first baffle duct (31). The airflow is redirected by the first baffle duct (31) into a smaller second baffle duct (55) wherein the airflow is compressed to increase the resistance of the airflow, which exits the enclosure cabinet through an audio port (70) formed in the enclosure cabinet (11) to reinforce the sound from the front of the speaker (26).

12 Claims, 3 Drawing Sheets

SPEAKER ENCLOSURE ASSEMBLY

FIELD OF THE INVENTION

The present invention relates to speaker enclosures. More particularly, the present invention relates to speaker enclosures having a series of interconnected ducts through which low frequency sound waves pass to increase the resonance of the sound waves and thus to enhance the low frequency or bass response of a speaker.

BACKGROUND OF THE INVENTION

Stereo systems for homes and especially for automobiles have become increasingly sophisticated in recent years to provide cleaner and sharper sound. The past several years have seen the development of compact discs and digital audio tape as part of an evolution of technology to provide better quality sound reproduction. The technology for speaker systems has also evolved to provide better quality sound transmission, even at high volumes. One problem that has received particular attention has been the problem of achieving good low frequency or bass response from speakers, especially at low end frequencies of 20–150 HZ. Poor response of low frequency or bass tones can cause popping or booming due to distortion of the sound at such low frequencies. This is especially a problem for automobile audio systems.

Formerly, speakers with large woofers were needed to provide high quality low frequency or bass tone response or reproduction. Attention has now been given to development of ported speaker enclosures such as bass reflex systems that are designed to enhance low frequency/bass response in speaker systems powered by relatively smaller speakers. Such ported speaker enclosures generally include a speaker cabinet in which a speaker is mounted. Baffles, folded tubes, or similar structures, are mounted within the speaker cabinet and define an audio transmission passageway therethrough. For example, U.S. Pat. Nos. 3,993,162 and 4,942,939 both disclose speaker enclosures having an enclosed cabinet with a series of interconnected tubes or baffles that define a labyrinthine passageway.

The principle behind such labyrinth enclosures is that as an airflow is generated within the speaker cabinet by the vibration of the speaker diaphragm, the airflow tends to bounce and move along the passageway defined by the tubes or baffles in a wave-like motion. Such movement causes the airflow to resinate at an increased rate as it moves along the audio passageway. The increased resonance of the airflow causes resonate peaks and provides an improved low frequency or bass tone response, even with smaller speakers. Variations on this concept are illustrated in U.S. Pat. Nos. 5,150,417, which discloses a speaker enclosure having a single substantially straight tube having series of openings formed along its length and covered by a membrane. U.S. Pat. No. 5,173,575 discloses a speaker enclosure having a relatively small cabinet having an externally extending resonance port that projects from a side of the speaker cabinet.

While such labyrinth type speaker enclosures have significantly improved the low frequency or bass response of conventional speaker systems, such systems are still subject to significant drawbacks. One major problem with such speaker enclosures is the size required for such enclosures. Prior art enclosures generally require large speaker cabinets which are bulky, heavy, and take up significant space, even though the speakers driving such systems are relatively small, in order to provide a sufficiently long audio passageway to enable enhanced resonance of the air flow within the enclosure. Such large cabinets are acceptable for use in a building or similar large structure, but take up too much space to be practical for installation in automobiles, especially in today's smaller compact cars. Such conventional speaker enclosures are also too large or bulky to be utilized in portable stereo systems or so called "bookshelf" systems.

Additionally, most conventional speaker enclosures are designed as an integral unit built around a specific speaker and thus cannot be adapted for use with other types of speakers and are often expensive to purchase and install. Further, conventional speaker enclosure assemblies are not tunable to fit the particular sound preferences of the listener. People hear sounds differently, and therefore some listeners may have a greater preference for a heavier bass, while other listeners will prefer greater treble. However, with most conventional speaker enclosure assemblies, the baffles or tubes of the assembly are fixedly mounted in an airtight cabinet and are therefore not tunable or adjustable so as to enable the tones produced by the enclosure to be tuned to fit the preference of the listener.

Accordingly, it can be seen that it would be desirable to provide a speaker enclosure assembly that enables enhanced low frequency or bass tone response to provide for improved sound quality, which assembly is extremely compact and which is tunable according to the preferences of the listener, and which is easily and inexpensively installed. It is to the provision of such a speaker enclosure assembly that the present invention is primarily directed.

SUMMARY OF THE INVENTION

Briefly described, the present invention comprises a speaker enclosure assembly having an enclosure cabinet defining an internal sound chamber therewithin. The enclosure cabinet includes upper and lower panels, a front panel, a rear panel, and a pair of parallel opposed side panels. A sound reproduction means such as an audio loudspeaker or similar driver is mounted in the front panel of the enclosure cabinet. The speaker generally includes a flexible diaphragm that is vibrated as an electrical signal is transmitted to the speaker for the transmission of sound by the speaker. The vibration of the speaker diaphragm generates an airflow behind the speaker, within the internal sound chamber of the speaker enclosure. This airflow produces low frequency or bass tones within the speaker enclosure.

A baffle means is mounted within the internal sound chamber of the enclosure cabinet adjacent the speaker. The baffle means includes a first baffle duct and a second baffle duct adjustably attached to the first baffle duct. The attached baffle ducts define a sound transmission pathway from the internal sound chamber of the enclosure cabinet through the front panel of the enclosure cabinet. The first baffle duct is a substantially cylindrically shaped tube having a first end, which is enclosed, and a second, open end, spaced from its first end, defining an open ended sound chamber within the first baffle duct. A collar is mounted within the first baffle duct at the open end of the first baffle duct. The collar is an open-ended tubular section having an inner side wall in which a helical groove is formed adjacent one end.

The second baffle duct is of a substantially smaller diameter than the first baffle duct and engages the collar of the first baffle duct to attach the second baffle duct adjustably to the first baffle duct. The second baffle duct includes a proximal end adapted to be received through the collar, and a distal end that communicates with the ambient environment outside of the speaker enclosure cabinet through an audio port or aperture formed in the front panel of the enclosure cabinet. A helical thread or groove is formed about the outer side wall of the second baffle duct intermediate the proximal and distal ends thereof. The helical thread of the second baffle duct engages the helical groove formed in the collar to attach the second baffle duct adjustably to the collar.

The airflow generated within the enclosure cabinet by the speaker tends to reverberate or bounce off of the walls of the enclosure cabinet and is directed into the open second end of the first baffle duct, received within the sound chamber thereof. The airflow is then redirected into the smaller diameter second baffle duct, which tends to condense or compress the airflow. Such compression of the airflow significantly increases the resistance of the airflow to provide enhanced low frequency/bass tone response as the airflow exits the enclosure cabinet through the audio port formed in the front panel thereof. Further, the threaded attachment of the second duct within the collar of the first tubular duct enables easy adjustment of the length of the sound transmission pathway defined by the interconnected ducts to enable adjustment of the resonance of the airflow within the speaker enclosure cabinet. As a result, the speaker enclosure can be quickly and easily tuned to a preferred tonal sound quality of the listener.

DETAILED DESCRIPTION

Figure 1:
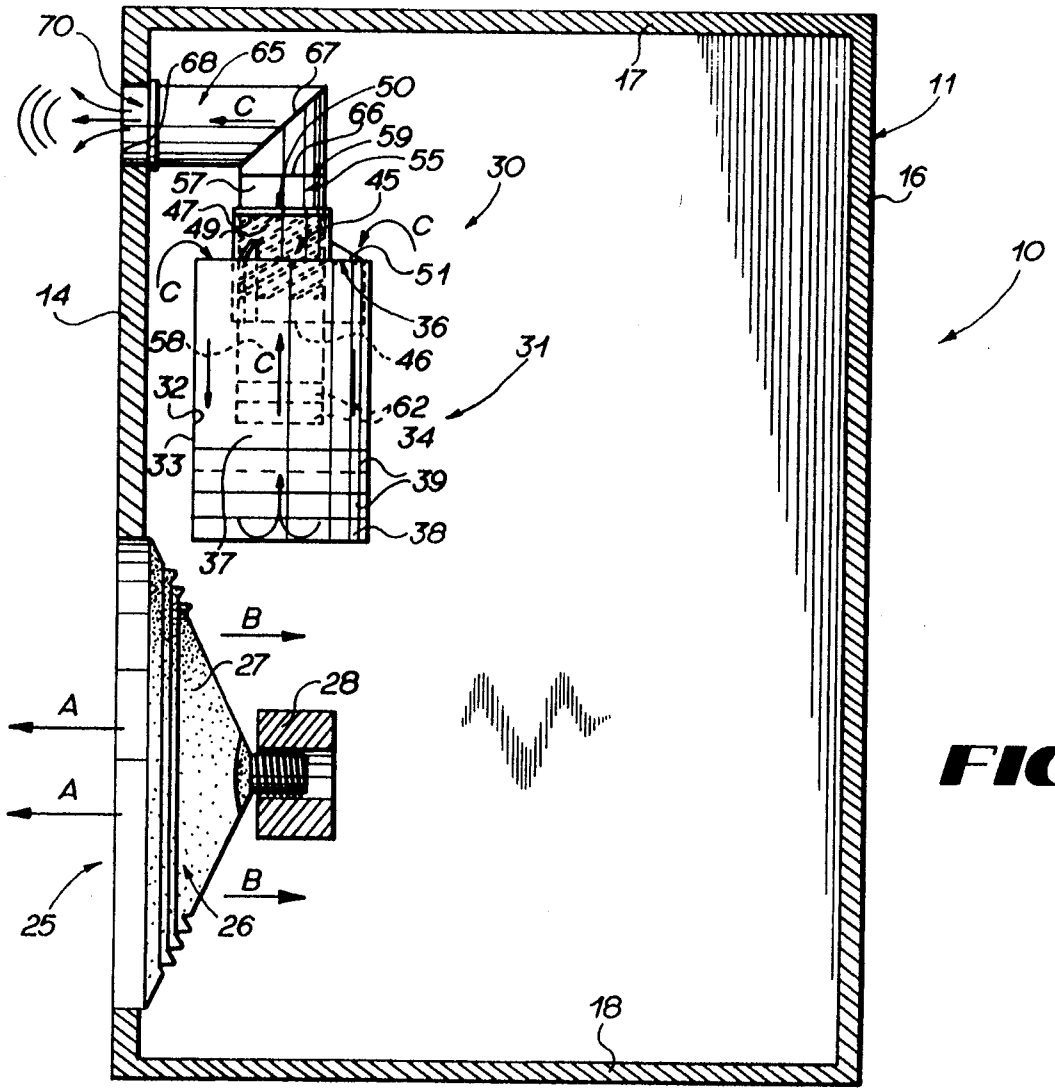
FIG. 1 is a sectioned view of a speaker enclosure assembly that embodies principals of this invention in a preferred form.

Referring now in greater detail to the drawings, in which like numerals reference like parts throughout the several views, FIG. 1 generally illustrates a speaker enclosure assembly 10 that embodies principles of this invention in a preferred form. The speaker enclosure assembly 10 includes an enclosure cabinet 11 typically formed as a substantially rectangular box, although other shapes or configurations can be used as desired. The enclosure cabinet 11 is generally formed from ¾ inch medium density fiberboard or other suitable material having desirable acoustic properties. The enclosure cabinet has upper and lower panels, a front panel 14, a rear panel 16 spaced from and extending parallel to the front panel 14 and a pair of spaced apart parallel side panels 17 and 18. The upper, lower, front, rear, and side panels of the enclosure cabinet are attached together at their edges by an adhesive, tacks, or similar fastening means (not shown), and the joints between the panels are sealed to form a substantially airtight enclosure. An internal sound chamber 19 is defined within the enclosure cabinet. The internal sound chamber 19 typically has a volume of approximately one-half to one and one-half cubic feet, although larger or smaller enclosures can be constructed as desired.

A sound reproduction means 25 is mounted within the front panel 14 of the enclosure cabinet 11. The sound reproduction means typically is a loudspeaker 26 or similar driver. As FIG. 1 illustrates, the speaker 26 is generally conically shaped having a flexible diaphragm or membrane 27 and a magnet 28. As an electrical signal is transmitted to the speaker 26 for the transmission of sound by the speaker, the flexible diaphragm 27 vibrates. The vibration of the diaphragm of the speaker creates an airflow both in front and behind the speaker. The airflow generated in front of the speaker, indicated by arrows A, produces bass-midrange tones, while the airflow generated at the rear of the speaker, indicated by arrows B, produces the low frequency or bass tones. The airflow produced at the rear of the speaker is reflected off of the side and end walls 14, 16, 17, and 18 of the enclosure cabinet 11, which increases the resonance of the airflow and thus increases the low frequency or bass response produced by the speaker.

Figure 2:
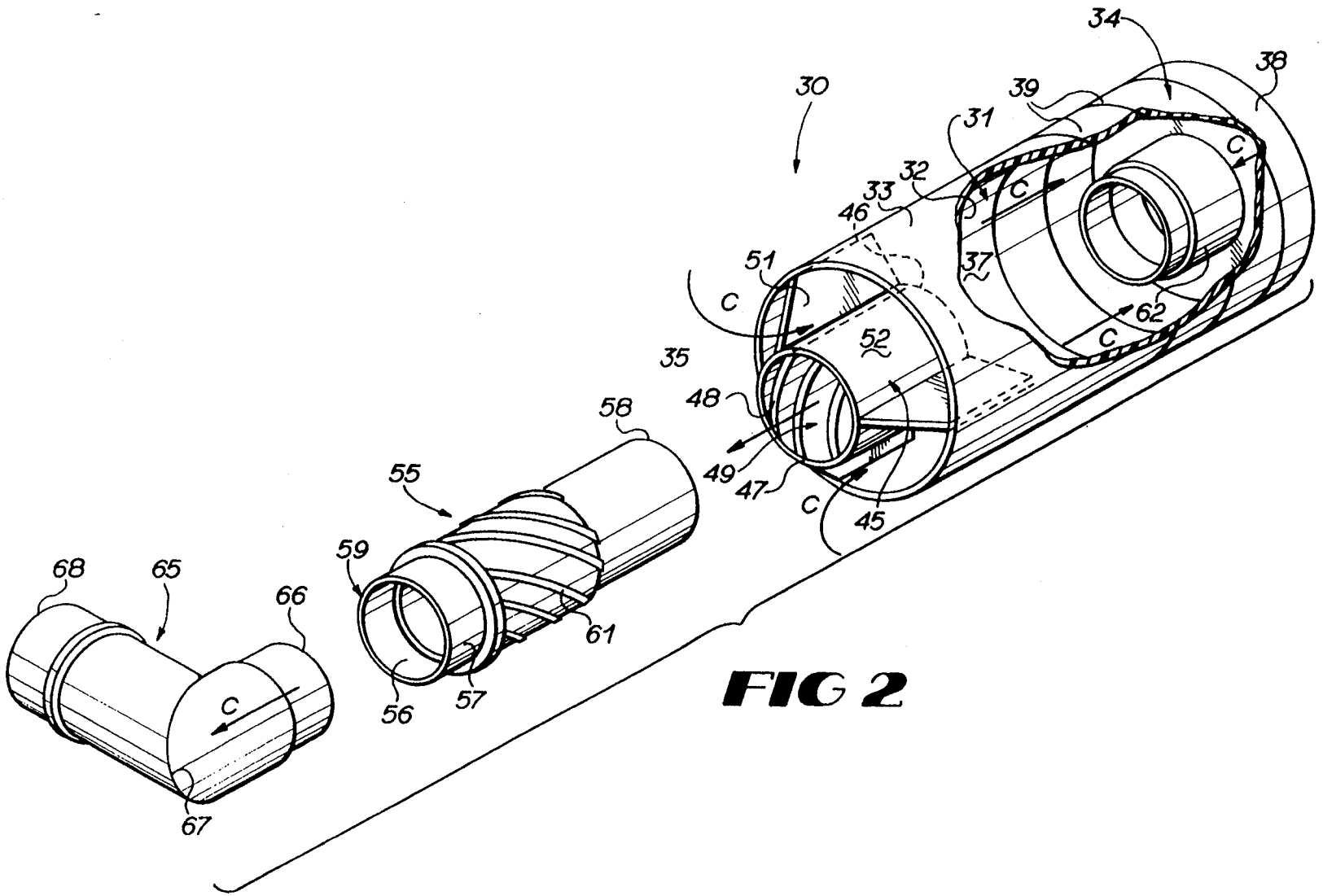
FIG. 2 is an exploded perspective view of the baffle means of this invention, with portions cut away to illustrate internal structure.

A baffle means 30 is mounted within the internal sound chamber 19 of the enclosure cabinet 11 adjacent the speaker 26 and defines a sound transmission pathway, indicated by arrows C. The sound transmission pathway extends in a labyrinthine fashion through the internal sound chamber 19 and through the front panel 14 of the enclosure cabinet 11 to the environment surrounding the speaker enclosure assembly 10. The baffle means 30 includes a first large diameter baffle duct formed from polyvinyl chloride or a similar plastic material. The first baffle duct is typically a tubularly shaped pipe or canister having an inner diameter of approximately 4 inches and being approximately 4–6 inches in length, although larger or smaller tubular pipes can be utilized as desired. As FIG. 2 illustrates, the first baffle duct 31 has a substantially cylindrical inner side wall 32 and an outer side wall 33 and includes a first end 34, which is enclosed, and a second, open end 36 spaced from the closed first end 34. An open ended audio cavity or chamber 37 is thus formed within the first baffle duct 31, defined by the inner side wall and the closed first end of the first baffle duct.

An end cap 38 is attached to the first baffle duct at the first end 34 of the first baffle duct 31 to enclose the first end thereof. The end cap is formed from the same plastic material as the first baffle duct and is a circular, disc-shaped cap having approximately the same diameter as the first baffle duct so as to mate with the first end of the first baffle duct. It is also possible to provide the end cap with an outwardly projecting flange or sleeve of a diameter slightly less than that of the first baffle duct and which is received within and frictionally engages the inner side wall 32 of the first baffle duct to attach the end cap thereto.

Spacers 39 (FIG. 2) can be mounted between the first end 34 of the first tubular duct 31 and the end cap 38 for lengthening the first baffle duct for tuning the speaker enclosure assembly 10 as necessary. It will be understood that such spacers are added as necessary or desired, and there will be occasions where no spacers will be required or one or more spacers will be necessary or desired. The spacers are shortened tubular sections or rings formed from the same plastic material as the first baffle duct and are of approximately the same diameter as the first baffle duct to mate closely with the first end 34 of the first baffle duct 31. An adhesive such as a pvc cement or similar adhesive means is applied between the first end of the first baffle duct and the spacers 39 and/or end cap 38 to attach the end cap and/or spacers to the first end of the first baffle duct.

As FIG. 2 illustrates, an open ended collar 45 is mounted within the first baffle duct 31 at the second end 36 thereof. The collar 45 is spaced from the inner side wall 32 of the first baffle duct, approximately centered within the audio cavity 37 of the first baffle duct. The collar is a substantially cylindrical section of pipe or tubing formed from a plastic material such as polyvinyl chloride as used to form the first baffle duct, and can be a separate piece or can be molded as an integral piece of the first baffle duct during the formation of the first baffle duct. The collar has a diameter of somewhat less than that of the first baffle duct, typically approximately 2¼ inches, and is approximately 2–3 inches in length. As shown in FIG. 2, the collar includes a proximal end 46 that extends into the audio cavity 37 of the first baffle duct, and a distal end 47 that projects slightly outwardly from the second end 36 of the first baffle duct. A helical groove or thread 48 is formed along an inner side wall 49 of the collar 45. A series of angled struts or supports 51 are mounted to the outer side wall 52 of the collar 45 and to the inner side wall 32 of the first baffle duct 31 to mount the collar 45 within the first baffle duct, spaced from the inner side wall thereof.

As FIG. 2 illustrates, a second baffle duct 55 is adjustably attached to the first baffle duct 31 by the collar 45. The second baffle duct 55 typically is a tubular part or pipe formed from the same plastic material as the first baffle duct, with a substantially smaller diameter than the first baffle duct, approximately one and one-half to two times less than the diameter of the first baffle duct and slightly less than the diameter of the collar 45. Typically, the second baffle duct has a diameter of approximately 2 inches for a first baffle duct having a diameter of approximately 4 inches. The second baffle duct generally is approximately 4–5 inches in length, although other lengths and diameter tubes can be used as desired. The second baffle duct includes an inner side wall 56 and an outer side wall 57, a proximal end 58 adapted to be received through the collar 45 of the first baffle duct 31, and a distal end 59 spaced from its proximal end 58. As FIG. 2 illustrates, the second tubular duct is inserted through the collar with its proximal end 58 projecting out of the proximal end 46 of the collar.

Helical threads 61 are formed about the outer side wall 57 of the second baffle duct 55 along the length of the second baffle duct intermediate the proximal distal ends 58 and 59 thereof. As FIG. 2 shows, the helical threads 61 threadably engage the helical groove 48 formed in the inner side wall 49 of the collar 45 of the first baffle duct to attach the second baffle duct adjustably to the collar as the proximal end 58 of the second baffle duct is received through the collar. Spacers 62, shown in FIG. 2, can be attached to the proximal end 58 of the second baffle duct as it projects from the distal end of the collar to lengthen the second baffle duct 55 as required. The spacers are typically formed from the same plastic material as the baffle ducts and are hollow, substantially tubular sections or rings adapted to engage and fit about the proximal end of the second baffle duct. The spacers are attached to the proximal end of the second baffle duct by an adhesive means (not shown).

As shown in FIGS. 1 and 2 an extension tube 65 is attached to the distal end 59 of the second baffle duct and projects away from the second baffle duct. The extension tube 65 typically is a substantially cylindrical pipe or tube, here illustrated as an L-shaped tube such as an elbow-joint, typically formed from the same plastic material as used to form the first and second baffle ducts 31 and 55. The extension tube 65 has an inlet end 66 having a diameter slightly less than the diameter of the distal end 59 of the second baffle duct 55 such that the inlet end 66 of the extension tube is received within and frictionally engages the inner side wall 56 of the second baffle duct. The inlet end 66 of the extension tube is secured within the second baffle duct by joint compound or similar adhesive means. As illustrated in FIG. 2, the extension tube has a bend 67 formed along its length, and terminates at an exit end 68. The exit end 68 of the extension tube attaches to the front panel 14 of the enclosure cabinet 11 at an audio port 70 formed through the front panel. An adhesive seal is applied about the exit end 68 of the extension tube 65 at the audio port 70 to seal any gaps or cracks between the exit end 68 of the extension tube and the audio port of the enclosure cabinet.

In use, as illustrated in FIG. 1, the baffle means 30 is mounted within an enclosure cabinet 11 for a speaker enclosure 10 by the attachment of the exit end 68 of an L-shaped extension tube 65 to the front panel 14 of the enclosure cabinet 11 at the audio port 70 formed therethrough. The extension tube is attached at its inlet end 66 to the distal end 59 of a second baffle duct 55. The second baffle duct 55 is adjustably attached to the larger diameter first baffle duct 31 by the engagement of helical threads 61 formed about the outer side wall 57 of the second baffle duct with a helical groove 48 formed along the inner side wall 49 of the collar 45 (FIG. 2) of the first baffle duct. An end cap 38 is applied over the first end 34 of the first baffle duct 31 to enclose the first end 34 of the first baffle duct.

An electronic signal is transmitted to the speaker 26 or similar means for the reproduction of sound by the speaker. In response, the speaker vibrates creating an airflow, indicated by arrows A, in front of the speaker to produce the bass-midrange tones of the sound, and also creating an airflow behind the speaker, indicated by arrows B, within the internal sound chamber 19 of the enclosure cabinet 11. The airflow created by the rear of the speaker produces low frequency or bass tones. The airflow tends to bounce or reverberate off of the side and end walls of the enclosure cabinet, which increases the resistance of the airflow and thus the resonance of the low frequency tones.

As illustrated in FIGS. 1 and 2, the airflow generated by the rear of the speaker moves along a sound transmission pathway indicated by arrows C, and is directed into the second end 36 of the first baffle duct, into the audio cavity 37 thereof. The airflow is reflected off of the end cap 38 at the first end 34 of the first baffle duct and is redirected into the open proximal end 46 of the smaller second baffle duct. As the airflow enters the second baffle duct, it is compressed, which further increases the resistance, in effect doubling the resistance of the airflow and thus increases the low frequency or bass response produced by such airflow. The airflow proceeds along the second baffle duct and through extension tube 65 and exits the enclosure cabinet 11 (FIG. 1) through the audio port 70 adjacent the speaker 26.

The resonance of the bass tone produced within the enclosure by the baffle means is adjusted or tuned to achieve a desired tonal quality or frequency response by rotating the first baffle duct with respect to the second baffle duct to extend the threaded connection between the second baffle duct and the collar 45 of the first baffle duct. The first and second baffle ducts are thus adjustable lengthwise in order to lengthen or shorten the sound transmission pathway to increase or decrease the resonance of the low frequency/bass tones. Additionally, spacers can be inserted between the end cap 38 and the first end 34 of the first baffle duct to extend the length of the sound transmission pathway as needed to increase or enhance the resonance of the low frequency/bass tones. Likewise, spacers 62 can be attached to the proximal end of the second baffle duct 55 to further lengthen the second baffle duct as needed. Once the enclosure has been tuned to achieve the desired low frequency or bass tone response, the enclosure is sealed.

The present invention provides for an enhanced low frequency/bass response to achieve a clearer and cleaner sound from the speaker, but is relatively compact and light weight and is easily constructed and mounted in areas of limited space. Further, the present invention enables the enclosure to be quickly and easily tuned to achieve a bass tone low frequency response desired or preferred by a listener.

Figure 3:
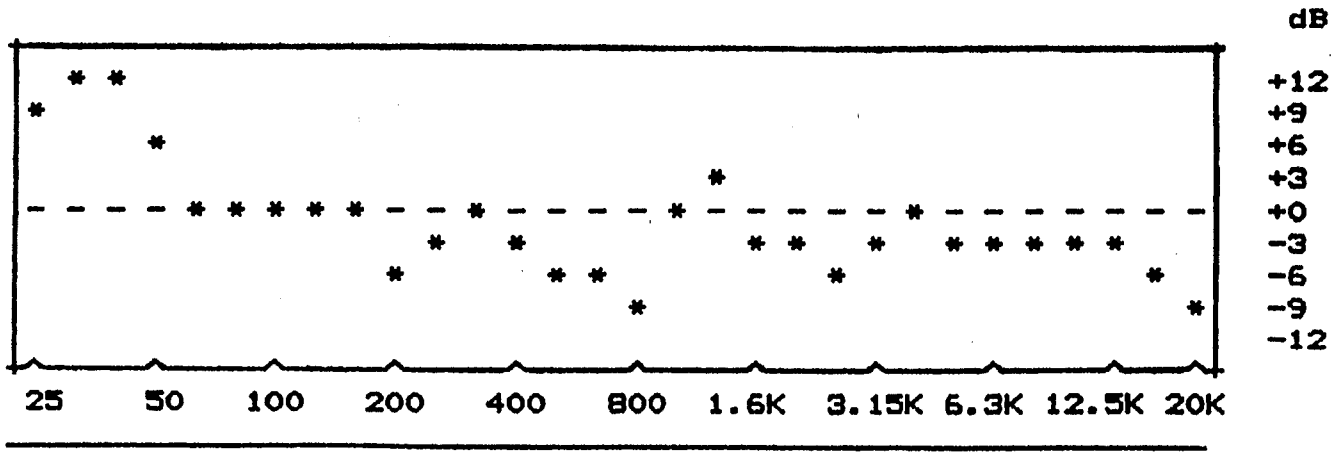
FIG. 3 is a X-Y graph of the frequency response of the speaker enclosure assembly of the present invention frequencies.

The results of a test conducted with the present invention in which the frequency response provided by the present invention was scored using an HAL-100 IASCA scoring computer are summarized in the Table of FIG. 3. This test was conducted using a 10" Cerwin Vega XL10S speaker driven by a 60 watt amplifier, mounted in the trunk of a subcompact automobile. At a 25 HZ tone a +9 decibel response was produced and at +12 decibels, the frequency response remained constant from 35.1–40 HZ, and over a range of approximately 63 HZ to 160 HZ, the frequency response remained constant at 0 db. The present invention thus provides exceptional low frequency/bass response even at extremely low frequencies.

The features and principles of the present invention have been illustrated in the foregoing description of a preferred embodiment thereof. It will be apparent to those skilled in the art that numerous changes or modifications may be made thereto without departure from the spirit and scope of the invention.

I claim:

1. A speaker enclosure comprising:

an enclosure cabinet defining an internal audio chamber therewithin;

sound reproduction means mounted in a wall of said enclosure cabinet and projecting partially into said internal chamber for generating an airflow within said internal chamber; and baffle means mounted to a wall of said enclosure cabinet adjacent said sound reproduction means, said baffle means comprising a first baffle duct having a substantially closed first end and an open second end through which the airflow is received, and a second baffle duct of a substantially smaller size than said first baffle duct and having a proximal end mounted to said first baffle duct in communication therewith and a distal end communicating with an audio port formed through said enclosure cabinet, said proximal end of said second duct being adjustable toward and away from said closed end of said first baffle duct to adjust the resistance on the airflow as the airflow is redirected through said second baffle duct to create a desired resonance, said baffle means further including a collar mounted approximately centrally within said first baffle duct and having threads formed within said collar, and wherein said second baffle duct further includes threads positioned along its length intermediate its ends which threads engage said threads of said collar to adjustably attach said second baffle duct to said first baffle duct;

whereby the airflow generated by the sound reproduction means passes through the open end of the first baffle duct and is redirected into the second baffle duct and is compressed to enhance the resonance of the airflow.

2. The speaker enclosure of claim 1 and wherein said sound reproduction means comprises a loudspeaker.

3. The speaker enclosure of claim 1 and further including means for redirecting the airflow, comprising an end cap mounted to said first baffle duct at said first end thereof for enclosing said first end.

4. The speaker enclosure of claim 3 and further including a plurality of spacer members adapted to be mounted between said end cap and said first end of said first baffle duct to extend said first baffle duct.

5. The speaker enclosure of claim 1 and further including an extension tube mounted between said distal end of said second baffle duct and said audio port of said enclosure cabinet to connect said distal end to said audio port.

6. A speaker system for providing enhanced low frequency response from a speaker, comprising:

a speaker enclosure cabinet;

a speaker mounted in a panel of said enclosure cabinet for generating sound waves within said enclosure cabinet;

first baffle duct mounted within said enclosure cabinet, comprising a substantially tubular member having an open end through which the sound waves are received and an enclosed end for redirecting the sound waves within said first baffle duct;

second baffle duct mounted to said first baffle duct, comprising a substantially tubular, open-ended member having a substantially smaller diameter than said first baffle duct and through which the sound waves are redirected and pass along and in which the sound waves are condensed to increase the resonance of the sound waves to enhance the low frequency response of the sound waves, and said second baffle duct having a proximal end through which the sound waves are received and a distal end attached to said speaker enclosure cabinet;

means for adjustably mounting said proximal end of said second baffle duct to said open end of said first baffle duct so as to enable said proximal end to be adjusted toward and away from said enclosed end of said first baffle duct to adjust the resistance on the sound waves redirected into said second baffle duct to adjust the low frequency response of the sound waves to a desired tonal quality;

wherein said means for adjustably mounting comprises an open-ended collar mounted within said first baffle duct and having a thread formed therewithin, and wherein said second baffle duct further includes a thread positioned along its length intermediate its ends thereof, which thread engages said thread of said collar to adjustably attach said second baffle duct to said first baffle duct.

7. The speaker system of claim 6 and further including an end cap mounted to said enclosed end of said first baffle duct for enclosing said enclosed end.

8. The speaker system of claim 6 and wherein said first and second baffle ducts are formed of a plastic material.

9. The speaker system of claim 6 and wherein the positions of said first and second baffle ducts are adjustable with respect to one another to enable adjustment of the resonance of the sound waves within said speaker enclosure cabinet as desired to enhance the low frequency response of the sound waves.

10. An apparatus for use in conjunction with a loudspeaker cabinet for enhancing the low frequency response of the loudspeaker, said apparatus comprising:

a canister sized to fit within the loudspeaker cabinet, said canister having a substantially closed end and a substantially open end adapted to receive a flow of air generated by the loudspeaker within the cabinet and side walls defining an interior cavity within said canister, a tubular port adjustably mounted within said canister and having a first end extending through said open end of said canister and projecting into said interior cavity and through which the airflow is directed, and a second end positioned outside said canister;

said second end of said tubular port being adapted to communicate through said loudspeaker cabinet to ambiance;

a collar mounted within said canister adapted to receive said tubular port therethrough and having a thread formed along an internal wall thereof, and wherein said tubular port includes a thread formed thereabout, which engages said thread of said collars to adjustably attach said tubular duct to said canister;

said tubular port being lengthwise adjustable with respect to said canister so as to move said first end thereof toward and away from said closed end of said canister to vary resistance on the airflow passing through said canister and said tubular port to enable tuning of the loudspeaker cabinet as desired to enhance the low frequency response of the loudspeaker.

11. The apparatus of claim 10 and further including an extension tube mounted at one end to said second end of said tubular port and at an opposite end to the loudspeaker cabinet at the audio port formed therethrough for connecting said tubular port to the audio port.

12. The apparatus of claim 10 and wherein said canister and said tubular port comprise a plastic material.

* * * * *